US005651537A

United States Patent [19]

Morii et al.

[11] Patent Number: 5,651,537

[45] Date of Patent: Jul. 29, 1997

[54] STACKED SHEET CLAMPING DEVICE FOR A STAPLER

[75] Inventors: Nobuyuki Morii; Masashi Shimada, both of Okazaki; Katsumi Yoshii; Yuichi Fujii, both of Nagoya; Yoshihide Sugiyama, Okazaki, all of Japan

[73] Assignee: Ricoh Company, Ltd., Tokyo, Japan

[21] Appl. No.: 523,624

[22] Filed: Sep. 5, 1995

[30] Foreign Application Priority Data

Sep. 5, 1994 [JP] Japan ..... 6-211349

[51] Int. Cl.[6] ..... B65H 39/02

[52] U.S. Cl. ..... 270/58.11; 270/58.28

[58] Field of Search ..... 270/58.08, 58.11, 270/58.13, 58.14, 58.28; 271/220; 198/468.2, 468.9

[56] References Cited

U.S. PATENT DOCUMENTS 4,545,715 10/1985 Seefeldt ..... 198/468.2 X 4,575,296 3/1986 Kockler et al. ..... 270/58.08 X 5,388,819 2/1995 Ushirogata ..... 270/58.11 X 5,447,298 9/1995 Watanabe et al. ..... 270/58.11

*Primary Examiner*—Hoang Nguyen

*Attorney, Agent, or Firm*—Oblon, Spivak, McClelland, Maier & Neustadt, P.C.

[57] ABSTRACT

A clamping device for clamping sheets stacked on a bin of a sorter is composed of a moving unit, on which clamp levers are mounted, and an unshakable unit, on which an opening and closing mechanism for the clamp levers and a moving mechanism for moving the moving unit in the state of keeping the clamping of the sheets, are mounted. Thereby, a solenoid for opening or closing the clamp levers mounted on the moving unit and a wire harness connecting electrical device mounted on the moving device with a connector mounted on the unshakable unit are omitted.

7 Claims, 6 Drawing Sheets

STACKED SHEET CLAMPING DEVICE FOR A STAPLER

BACKGROUND OF THE INVENTION

1. Field of the Invention

The present invention relates to a clamping device for clamping copied sheets stacked on a bin of a sorter attached to an image forming apparatus such as, for example, a copier, a printer and so on.

2. Description of the Related Prior Art

In the stapling step, the copied sheets ejected on the bin of the sorter must be carried to the stapling position which is disposed beside the bin and where the stapler is disposed, so that the sheet stack is stapled by the stapler. Therefore, the clamping device for the stapler must be composed with a moving unit having clamp levers for clamping the sheets and an unshakable unit, along with which the moving unit is moved toward the clamping position and the stapling position.

In conventional clamping devices, two types were employed. One is that the motor for driving both the cam, which is connected with the clamp levers and the moving unit is mounted on the moving unit of the clamping device. Another is that the solenoid for driving the clamp levers is mounted in the moving unit, where as the motor for driving the moving unit is mounted on the unshakable unit.

However, in these conventional devices, there exist the following drawbacks.

a) The clamping device becomes bulky and complex. b) The moving device becomes heavy, so that a powerful motor is needed for moving the moving unit. c) A flexible electric wire-harness is needed because of the mounting of the solenoid on the moving unit. In addition, the wire harness tends to be break easily. d) The cost becomes higher due to employing the powerful solenoid or highly flexible electrical wire harness.

SUMMARY OF THE INVENTION

According to the present invention the above mentioned shortages are resolved due to the fact that the present invention is comprised as mentioned below.

Namely, a clamping device for clamping sheets stacked on a bin of the sorter is composed of a moving unit, on which clamp levers are mounted, and an unshakable unit, on which an opening and closing mechanism for the clamp levers and moving mechanism for moving the moving unit in the state of keeping clamping of the sheet, are mounted.

Thereby, a solenoid for opening or closing the clamp levers mounted on the moving unit and a wire harness connecting electrical device mounted on the moving device with a connecter mounted on the unshakable unit are omitted.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Herein after, the first embodiment of the present invention is described referring to the figures.

Figure 2:
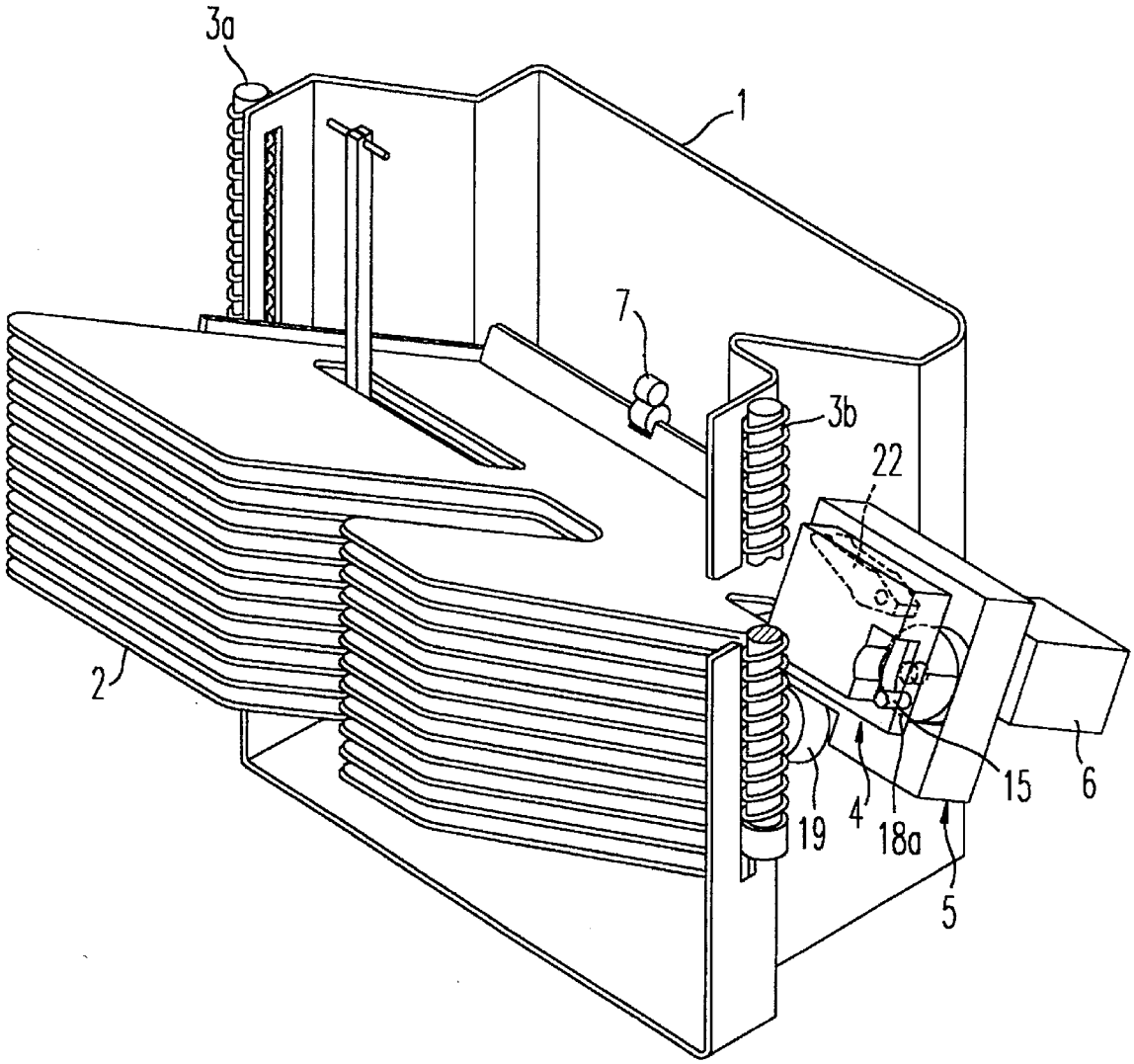
FIG. 2 is a perspective view of the sorter employing the present invention.
Figure 3:
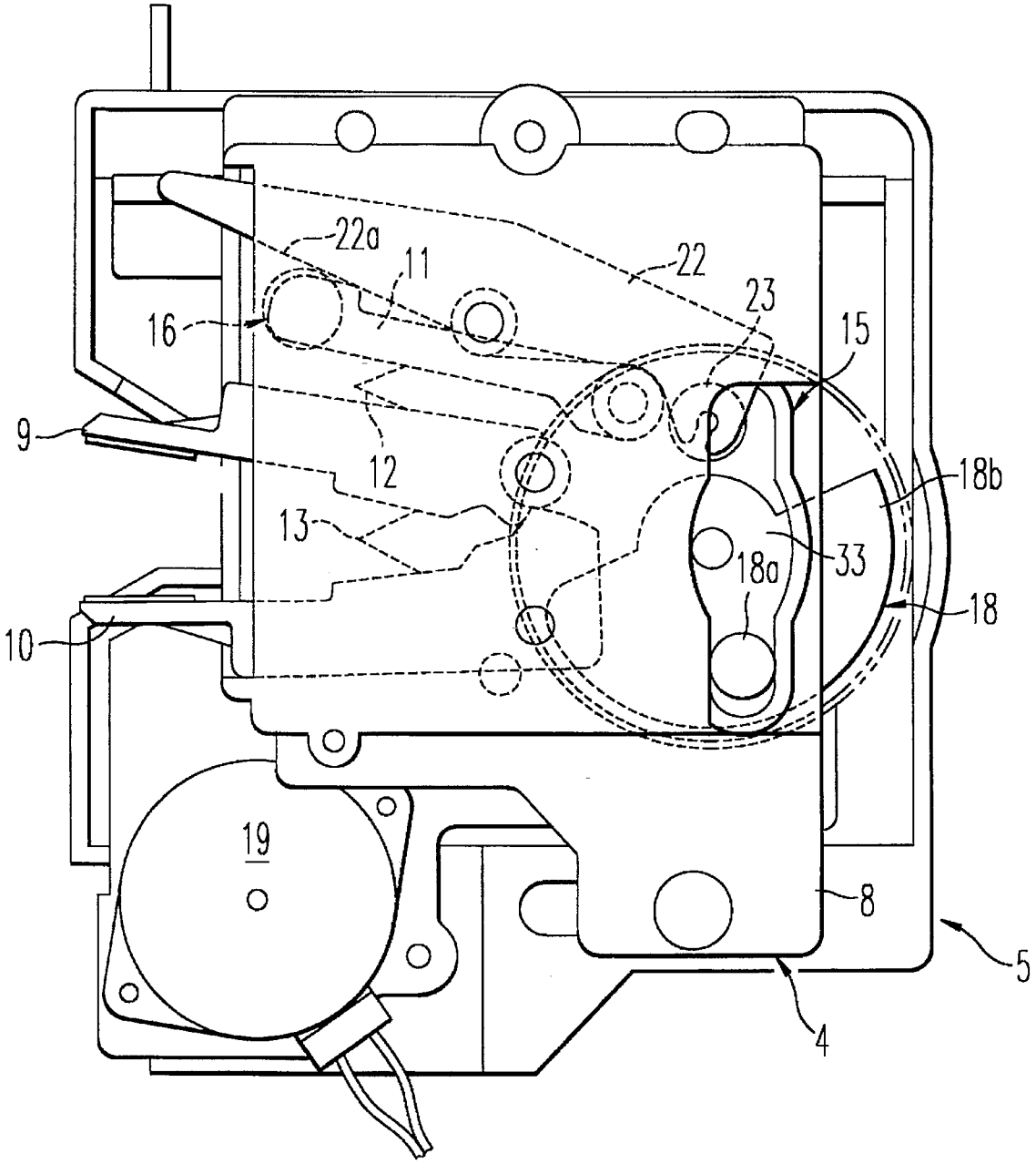
FIG. 3 is the sectional view of the clamping unit showing the first stage just before the moving unit starts to move.

Referring now to the drawings, wherein like reference numerals designate identical or corresponding parts throughout the several views, as shown in FIG. 2, a frame 1 having a rectangular cross section composes a sorter. In the frame 1, a plurality of bins 2 composed of plates are disposed vertically at predetermined intervals. A pair of rollers 7 are disposed therein to eject sheets onto each of the bins 2. A pair of spiral helical cams 3*a*, 3*b* are disposed beside the frame 1 in a manner of being rotatable for elevation of the bins 2. A clamping device is disposed adjacent to the helical cams 3*a*, 3*b*, and is composed of a moving unit 4 and an unshakable unit 5. A stapler 6 is also disposed adjacent to the helical cams 3*a*, 3*b*.

Figure 1:
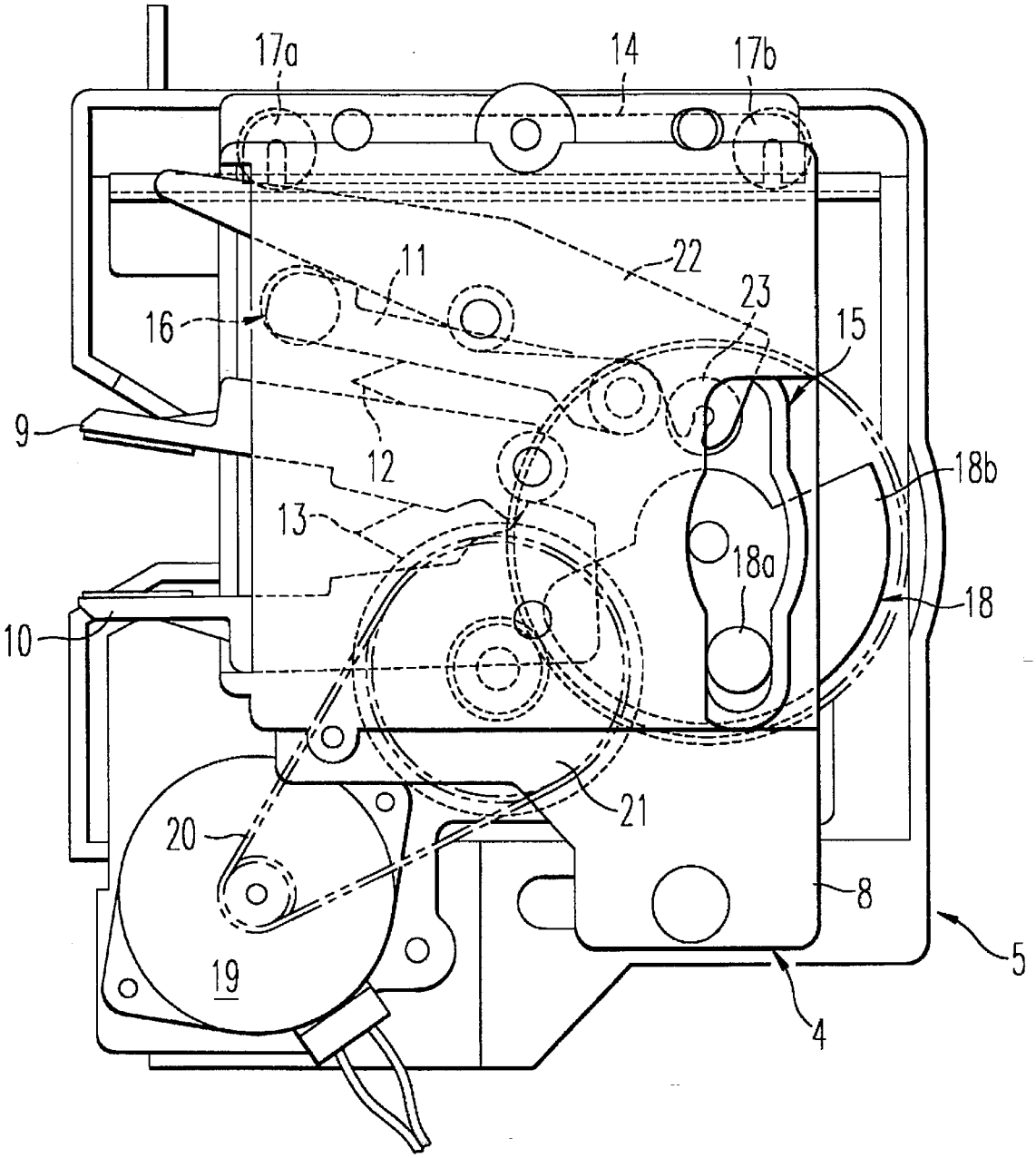
FIG. 1 is a sectional view of the clamping unit.

As shown in FIG. 1, the moving unit 4 is composed of below mentioned parts. Namely, a main frame 8, an upper clamp lever 9 pivotaly mounted to the main frame 8, a lower clamp lever 10 disposed below the upper clamp lever 9 and one end thereof is pivotaly, mounted on the main frame 8, a compressing spring 12 each end thereof is connected with an arm 11 and the upper clamp 9, and compressing spring 13 each end thereof connected with the upper clamp 9 and lower clamp 10, a sliding guide 14 (see FIG. 1) for guiding the moving unit 4 along with the unshakable unit 5 and an eccentric opening 15 formed on the main frame 8 for guiding a boss 18*a* as mentioned later.

Both the clamp levers 9 and 10 are contacted with each other at each the end portions thereof, thereby they cooperatively open and close themselves. A roller 16 is mounted on the arm 11 and the same makes upper clamp lever 9 swing counter-clockwise by pushing the spring 12 downwardly. The spring 13 is disposed among the clamp levers 9 and 10, and tends to open both clamps. A boss 18*a* mounted on a cam 18, detail of which is mentioned later, is inserted in the eccentric opening 15 made in the main frame 8. Thereby, the moving unit 4 move forward and backwards to either a clamping position or a stapling position if the cam 18 is rotated by a driving motor 19. The slide guide 14 is provided on the main frame 8 and has rollers 17*a*, 17*b* thereon thereby the moving unit 8 moves smoothly along with the unshakable unit 5.

In the unshakable unit 5, the reversibly rotatable driving motor 19, a timing belt 20 wound around a pulley mounted on the axis of the driving motor 19, a gear 21 rotated by the belt 20, another gear 32 substantially meshing with the gear 21, the cam 18 disposed coaxially with the axis of the gear 32 for moving the moving unit 4 and driving a pressing lever 22 are mounted. The cam 18 is formed in the shape of a half moon and composed of a long radius part 18*b* and a short radius part and having the boss 18*a* protruding therefrom.

Figure 4:
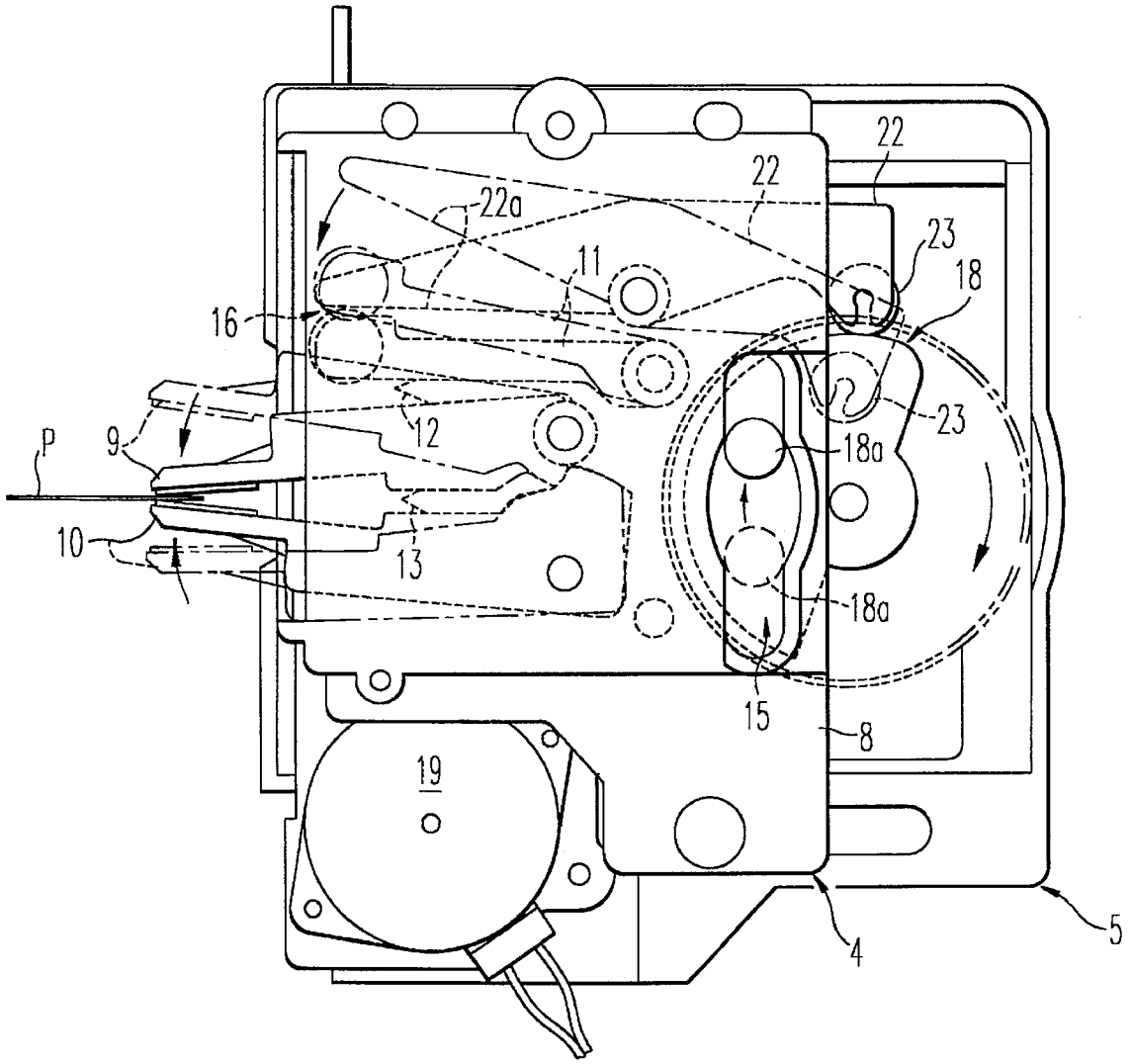
FIG. 4 is the sectional view of the clamping unit showing the movement of moving unit and clamp levers.

The pressing lever 22 has a roller 23 at one end thereof so that the same is able to minimize a friction which occurrs at a contacting portion with the long radius part 18*b* of the cam 18. The roller 23 is positioned at a relatively lower position and a contacting part 22*a* with the arm 11 of the pressing lever 22 is apart from the arm 11 when both the clamp levers 9 and 10 are opened. Whereas the roller 23 contacts with the periphery of the long radius part 18*b* of the cam 18 and a contacting part 22*a* thereof with the arm 11 contacts with the arm 11 when both the clamp levers 9 and 10 are closed as shown in FIG. 4. At the time, the contacting part 22*a* of the pressing lever 22 is kept horizontally.

Herein after, actual movement of the parts of the clamping device are explained referring to FIGS. 1, 3, 4 and 5.

Firstly, a start stage of the clamping by the clamping device is explained. The cam 18 for moving the moving unit 4 is positioned as shown in FIG. 1. The contacting part 22*a* is apart from the arm 11 and the roller 23 mounted on the pressing lever 22 is positioned at a relatively lower position as shown in FIG. 1. The boss 18*a* mounted on the cam 18 is positioned at a lowermost position in the eccentric opening 15 as shown in the FIG. 1, thereby the moving unit 4 does not move forward from the home position thereof. Secondly, if the cam 18 rotates clockwise, the boss 18*a* pushes the moving unit 4 forwardly. The eccentric opening 15 formed on the main frame 8 has a wide part 33 in the middle and a narrow part at both upper and bottom thereof. Therefore, when the boss 18*a* is sliding the wide part 33 of the eccentric opening 15, the moving unit does not move forward. This stage corresponds to clamping stage of the sheet P by both the clamp levers 9 and 10.

On the other hand the pressing lever 22 is positioned as mentioned below. In the case the cam 18 rotates clockwise and the moving unit 4 is forwarded, the contacting portion on the cam surface with the roller 23 of the pressing lever 22 is changed from the short radius part to the long radius part 18*b*. Thereby, the pressing arm 22 is swung counter-clockwise as illustrated by the arrow as shown in FIG. 4 and stopped in a state that the pressing part 22*a* keeps horizontal. During swinging of the pressing lever 22, the arm 11 is pressed, so that the upper clamp 9 and lower clamp 10 are cooperatively closed. Thereby, the sheet P on one of the bin 2 is clamped by the clamps 9 and 10.

Hereinafter, each state of each of the clamping devices during when the moving unit 4 is returned backwardly from the position where both the clamps 9 and 10 clamps the sheet P to the position where stapling is executed is explained.

Figure 5:
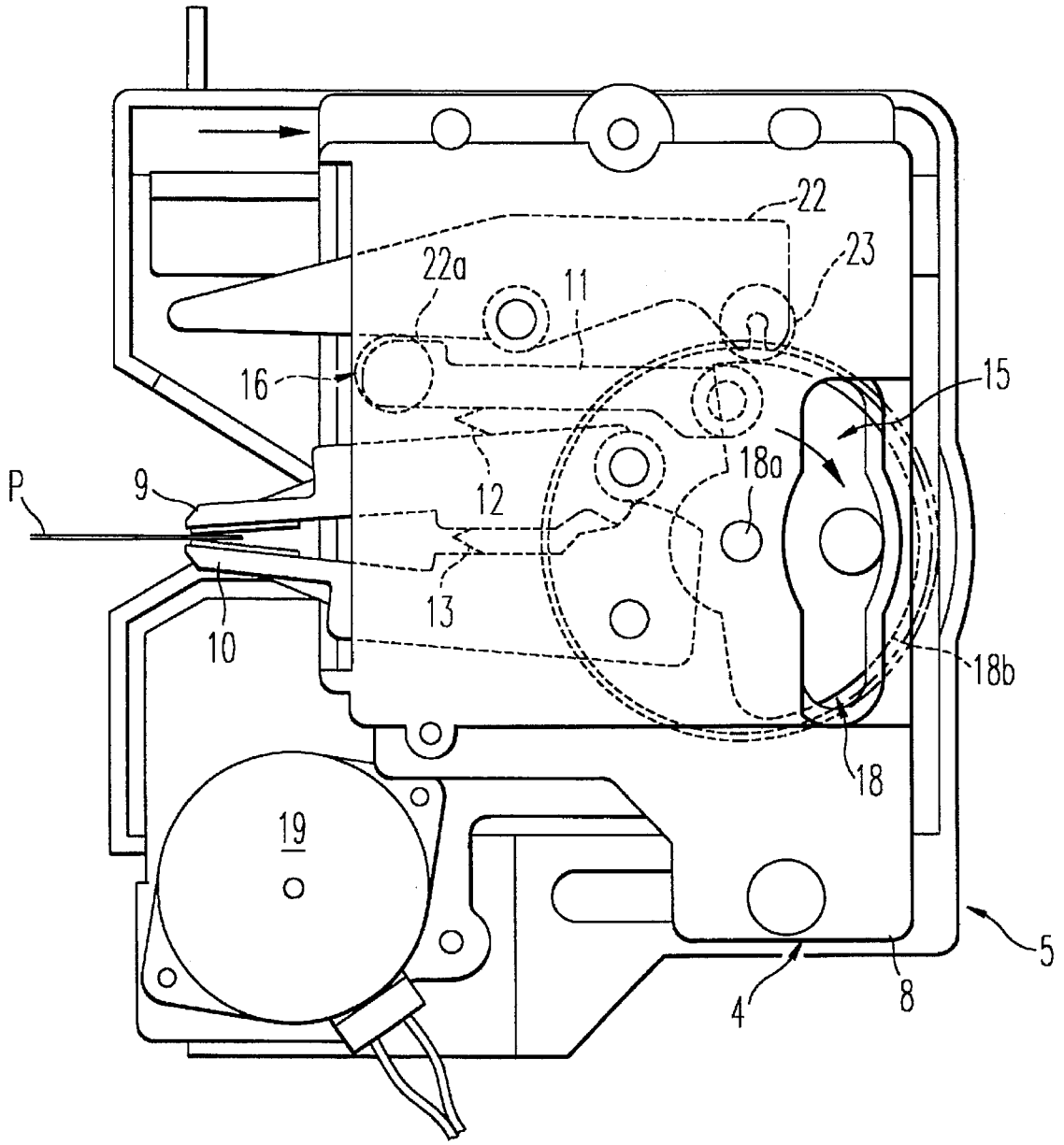
FIG. 5 is the sectional view of the clamping unit showing the stage of returning of the moving unit toward the stapling zone.

As shown in FIG. 5, the cam 18 further rotates and if the boss has passed the wide part 33 of the eccentric opening 15, the unit 4 begins to return through the home position to the stapling position. Due to wide part 33 of the opening 15 even if the cam further rotates the moving unit 4 keeps the same position, namely keeps a staple position. On the other hand, the pressing lever 22 keeps the pressing position, at same time both the clamps 9 and 10 are closed, and the pressing part 22*a* elongates horizontally as shown in FIG. 5. Therefore, in case thee moving unit 4 returns backwardly, the arm 11 mounted on the moving unit 4 keeps the same position by the help of the guidance of the pressing part 22*a* so that it continuously presses the upper clamp 9 and continues the clamping of the sheet P. Thereby, the sheet P is brought to the stapling position by the clamps 9 and 10. After that the stapler, not shown in the figures, is activated and the sheet P is stapled.

After the stapling is completed, the cam 18 is rotated in the counter clockwise direction. Therefore, the clamping devices mounted both on the moving unit 4 and the unshakable unit 5 are driven in the opposite direction as the direction driven when the cam 18 is rotated clockwise. Thereby, the sheet P being stapled is returned on the bin 2 and both the clamps 9 and 10 are released.

Figure 6:
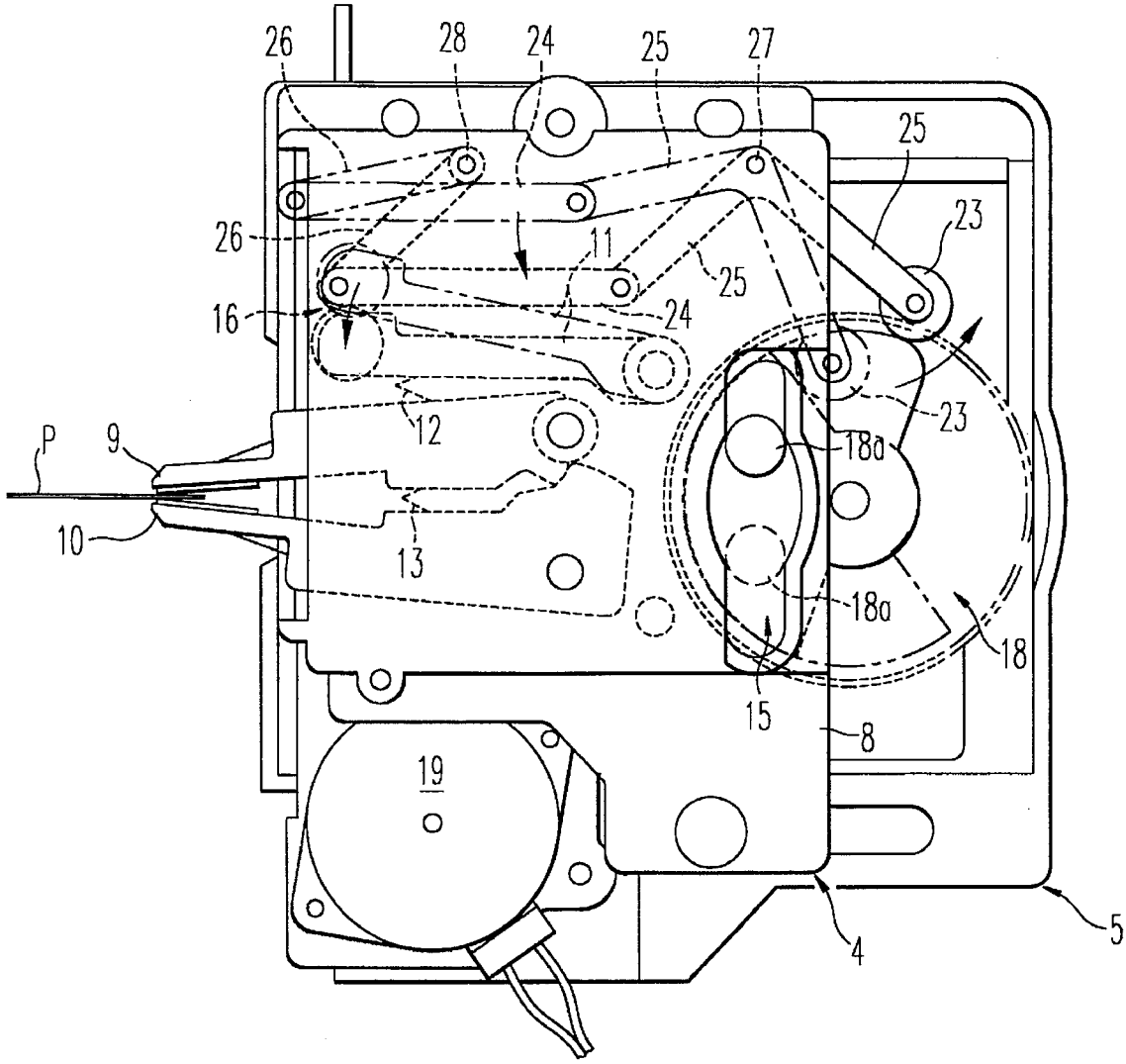
FIG. 6 is a sectional view of the clamping device of the another embodiment of the present invention.

Herein after, another embodiment of the present invention is explained referring to FIG. 6. In FIG. 6, the same device as shown in FIGS. 1, 3, 4 and 5 is numbered with the same reference numerals and an explanation for each device is omitted. The difference between the first embodiment and the second embodiment is only in the structure of the unshakable unit. As shown in FIG. 6, beside a reversible motor 19, a timing belt 20, a gear 21 and a cam 18, a parallel link bar 24 and a follower bar 25 one end thereof being connected to the parallel link bar 24 and pivotable around the pin 27 are mounted on the moving unit 4. The parallel link bar 24 is moved downwardly in a state of keeping a horizontal position. A additional link bar 26 is disposed on the unshakable unit 5 one end thereof is pivotably supported by a pin secured on the unshakable unit 5. Another end thereof is pivotably connected to the end of the parallel link bar 24 with a pin 28

Hereinafter, the actual movement of the clamping device mentioned above is explained. At the start stage of the clamping, the cam roller 23 mounted on the follower bar 25 positions on the shorter radius part of the cam 18 and the parallel link 24 is positioning apart from a roller 16 mounted on the arm 11 as illustrated by the dotted line as shown m FIG. 6. When the cam 18 is rotated and a contact part of the cam 18 with the roller 23 is changed from short radius part to long radius part 18*b*. Therefore, the follower bar 25 swings around the pin 27 counter clockwise and the parallel link 24 moves downwardly keeping a horizontal position from the position as illustrated by dotted line to that of the rigid line. Thereby the arm 11 and roller 16 mounted thereon are lowered by the parallel link bar 24 and both the clamps 9 and 10 are closed, so that the sheet P is clamped.

During returning of the moving unit 4 the roller 16 is guided by the parallel link 24, so that both the clamps 9 and 10 are kept closed. After that, the sheet P is stapled by the stapler 6 at the stapling zone and the cam 18 is rotated reversibly. Thereby the sheet P being stapled is returned onto one of the bins 2.

According to the present embodiment, the moving unit can be designed at light weight. As a result, the powerful and expensive driving motor is not needed. Due to not having to mount the electrical parts on the moving unit, the wire-harness is not needed between moving unit 4 and unshakable unit 5.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A clamping device for clamping copied sheets and bringing the clamped sheets toward a stapling position, the clamping device comprising:

a moving unit having clamp levers for clamping copied sheets stacked on a sheet receiving tray;

an unshakable unit secured in said clamping device and which slidably guides said moving unit; and a moving means for moving said moving unit toward a clamping position and the stapling position, and which is mounted on said unshakable unit;

said unshakable unit further comprising;

a) a pressing means for pressing the clamp levers when said moving unit is positioned at said clamping position so that said clamp levers are closed; and b) guiding means for guiding said moving unit in a state that said clamp levers are kept closed during a return of said moving unit from said clamping position to said stapling position, and which is mounted on said unshakable unit.

2. A clamping device as claimed in claim 1, further comprising:

a compressing spring disposed between said clamp levers for keeping said clamp levers open.

3. A clamping device as claimed in claim 1, wherein:

said pressing means is composed a lever pivotably mounted on said unshakable unit and one end thereof is contacting with a cam surface of a cam and another is facing to one of saint clamp levers and presses said clamp lever when said cam is rotated.

4. A clamping device as claimed in claim 1, wherein:

said guiding means is composed of a lower part of said pressing lever which elongates horizontal when said clamp levers are closed and guides roller mounted on said moving unit during returning thereof.

5. A clamping device as claimed in claim 1, wherein:

said moving means comprises a boss rotatably mounted on said unshakable unit, a motor for rotating said boss both clockwise and counter-clockwise and an opening formed on a plate mounted on said moving unit into which said boss is inserted.

6. A damping device as claimed in claim 5, wherein:

said opening is formed in a state that a middle portion thereof is relatively wide and both upper and lower parts are narrow.

7. A clamping device as claimed in claim 1, wherein:

said pressing means and guiding means is composed of a link bar movable downwardly while being in a horizontal position and linked with a cam follower contacting with a cam.

* * * * *